US011783970B2

(12) United States Patent
Ciapala et al.

(10) Patent No.: US 11,783,970 B2
(45) **Date of Patent: *Oct. 10, 2023**

(54) METHOD FOR CENTER TWISTING WIRES

(71) Applicant: Aptiv Technologies Limited, St. Michael (BB)

(72) Inventors: Frank A. Ciapala, Youngstown, OH (US); Jeffrey M. Handel, Canfield, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 50 days.

This patent is subject to a terminal disclaimer.

(21) Appl. No.: 18/075,830

(22) Filed: Dec. 6, 2022

(65) Prior Publication Data

US 2023/0100799 A1 Mar. 30, 2023

Related U.S. Application Data

(60) Continuation of application No. 17/689,353, filed on Mar. 8, 2022, now Pat. No. 11,600,409, which is a (Continued)

(51) Int. Cl.
*H01B 13/02* (2006.01)
*B21F 7/00* (2006.01)

(Continued)

(52) U.S. Cl.
CPC ..... *H01B 13/0207* (2013.01); *B21F 7/00* (2013.01); *B21F 15/04* (2013.01); *H01B 13/01236* (2013.01); *H01R 4/12* (2013.01)

(58) Field of Classification Search
CPC .. B21F 15/04; B21F 15/02; B21F 7/00; B21F 45/00; D07B 2201/1088; D07B 2201/2035; D02G 1/02

(Continued)

(56) References Cited

U.S. PATENT DOCUMENTS 1,543,520 A 6/1925 Reutter
1,572,907 A 2/1926 Bond (Continued)

FOREIGN PATENT DOCUMENTS

CN 103917310 A 7/2014
CN 107895610 A 4/2018

(Continued)

OTHER PUBLICATIONS

European Search Report for EP Application No. 20186497.2, dated Jan. 20, 2021, 5 pages.

(Continued)

*Primary Examiner* — Bobby Yeonjin Kim
(74) *Attorney, Agent, or Firm* — Billion & Armitage

(57) ABSTRACT

A method of twisting a pair of wires includes the steps of arranging a first wire parallel to a second wire along a longitudinal axis, securing ends of the first and second wires, and gripping outer surfaces of central portions of the first and second wires. The inner surfaces of the central portions of the first and second wires are in contact with one another. The method further includes deflecting central portions of the first and second wires orthogonally from the longitudinal axis and rotating the central portions of the central portions of the first and second wires, thereby twisting the first and second wires about one another.

14 Claims, 7 Drawing Sheets

Related U.S. Application Data division of application No. 16/515,753, filed on Jul. 18, 2019, now Pat. No. 11,309,105.

(51) Int. Cl.

| | |
|---|---|
| ***B21F 15/04*** | (2006.01) |
| ***H01R 4/12*** | (2006.01) |
| ***H01B 13/012*** | (2006.01) |

(58) Field of Classification Search

USPC ..... 140/117, 118, 119, 149; 57/334

See application file for complete search history.

(56) References Cited

U.S. PATENT DOCUMENTS

| | | | | |
|---|---|---|---|---|
| 1,581,794 | A | 4/1926 | Haven | |
| 2,498,920 | A | 2/1950 | Holland | |
| 2,604,883 | A | 7/1952 | Vitry | |
| 2,654,403 | A | 10/1953 | Ernest | |
| 2,796,662 | A * | 6/1957 | Saum | H01R 4/12 269/254 R |
| 2,831,356 | A * | 4/1958 | Wiman | B21F 15/04 140/149 |
| 3,052,079 | A | 9/1962 | Henning | |
| 5,494,081 | A | 2/1996 | Wiedel | |
| 5,605,181 | A | 2/1997 | Vuong | |
| 6,167,919 | B1 * | 1/2001 | Fuchsl | H01B 13/0207 140/149 |
| 9,117,573 | B2 | 8/2015 | Mclane et al. | |
| 9,194,079 | B2 | 11/2015 | Kudou et al. | |
| 9,899,128 | B1 | 2/2018 | Boyer et al. | |
| 2012/0055578 | A1 * | 3/2012 | Kodi | B21F 7/00 140/149 |
| 2014/0298770 | A1 | 10/2014 | Kudou et al. | |
| 2016/0027558 | A1 | 1/2016 | Boyer et al. | |
| 2018/0093849 | A1 | 4/2018 | Estermann et al. | |
| 2019/0214166 | A1 | 7/2019 | Shirai et al. | |
| 2019/0314885 | A1 | 10/2019 | Staubli et al. | |

FOREIGN PATENT DOCUMENTS

| | | | |
|---|---|---|---|
| CN | 108335803 | A | 7/2018 |
| CN | 109979692 | A | 7/2019 |
| DE | 7606095.0 | U1 | 6/1976 |
| DE | 7606095 | U1 | 6/1976 |
| DE | 2812208 | A1 | 10/1979 |
| DE | 3721199.4 | C1 | 12/1988 |
| DE | 3721199 | C1 | 12/1988 |
| EP | 0895254 | A1 | 2/1999 |
| FR | 2381379 | A1 | 9/1978 |
| JP | H08340627 | A | 12/1996 |
| JP | 2000149684 | A | 5/2000 |
| JP | 2001307569 | A | 11/2001 |
| JP | 2007220378 | A | 8/2007 |

OTHER PUBLICATIONS

"Communication under Rule 71(3) received for European Patent Application No. 20186494.9, dated Aug. 11, 2022", 7 pages.

"Decision to Grant a European Patent pursuant to Art. 97(1) EPC dated Sep. 22, 2022", 2 Pages.

* cited by examiner

METHOD FOR CENTER TWISTING WIRES

CROSS-REFERENCE TO RELATED APPLICATION

This application is a continuation application of U.S. patent application Ser. No. 17/689,353, filed Mar. 8, 2022, which is a divisional application of U.S. patent application Ser. No. 16/515,753, filed Jul. 18, 2019, now U.S. Pat. No. 11,309,105, the entire disclosure of each of which is hereby incorporated by reference.

TECHNICAL FIELD

The disclosure generally relates to an apparatus and a method for twisting wires, particularly to an apparatus and method for center twisting pairs of wires.

BACKGROUND

A twisted pair is a type of wiring in which two conductors of a single circuit are twisted together for the purposes of improving electromagnetic compatibility (EMC). Compared to a single conductor or an untwisted balanced pair, a twisted pair reduces electromagnetic radiation from the twisted pair and crosstalk between neighboring pairs and improves rejection of external electromagnetic interference (EMI).

Twisted pairs have been formed by arranging a pair of parallel wires, securing the ends of the wires, and then rotating one or both ends of the wires so that the wire pair is twisted one about the other. The ends of the wires may be terminated before or after twisting. However, the terminated wire pair may be inserted into a connector body only after the twisting process is complete. This inhibits the use of equipment to automatically insert the terminated ends of the wires into the connector bodies, since the twisted wires are difficult for an automated actuator to grip.

Therefore, a means of twisting wire pairs that is compatible with automated terminal insertion equipment remains desired.

BRIEF SUMMARY

According to embodiment, a method of twisting a pair of wires is provided. The method includes the steps of:

a) arranging a first wire parallel to a second wire along a longitudinal axis;

b) securing ends of the first and second wires;

c) gripping outer surfaces of central portions of the first and second wires, wherein inner surfaces of the central portions of the first and second wires are in contact with one another;

d) deflecting central portions of the first and second wires orthogonally from the longitudinal axis; and e) rotating the central portions of the central portions of the first and second wires, thereby twisting the first and second wires about one another.

BRIEF DESCRIPTION OF THE DRAWINGS

Embodiments will now be described, by way of example with reference to the accompanying drawings, in which.

DETAILED DESCRIPTION

Figure 1A:
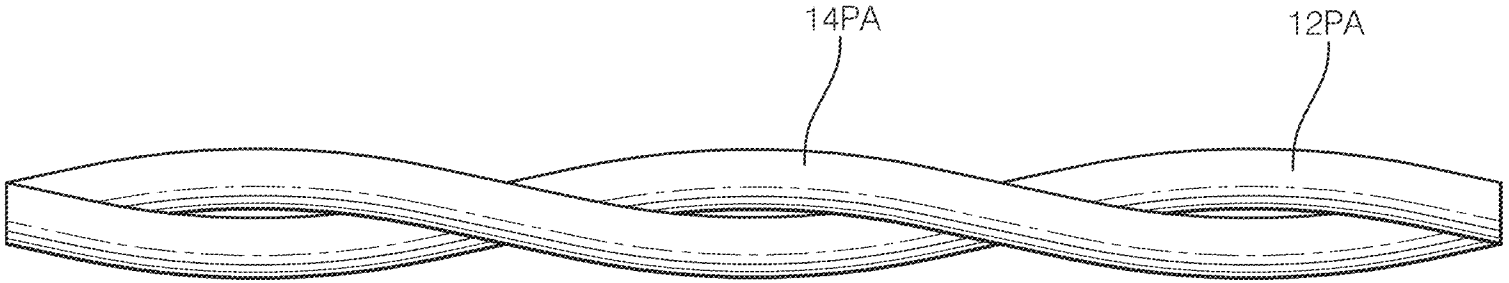
PRIOR ART FIG. 1A
FIG. 1A is a side view of a twisted pair of wires formed by a method or apparatus according to the prior art.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

FIGS. 1B to 5 and 7 to 9 illustrate a non-limiting example of an apparatus 100 configured to center twist a first wire 12 about a second wire 14 according to one or more embodiments. As used herein, the first and second wires 12, 14 each include a an electrical conductor surrounded by an insulation layer. The apparatus 100 includes a securing mechanism 102 that is configured to secure ends of the first wire 12 and the second wire 14. The ends of the wires may be terminated by electrical terminals (not shown) while they are secured by the securing mechanism 102 and may further be disposed within terminal cavities of a connector body 16 that is secured by the securing mechanism 102. The securing mechanism 102 may include a pair of clamping jaws 104 that open to allow placement of the wire ends within the securing mechanism 102 and then close to secure the wire ends. The clamping jaws 104 may be manually or automatically operated. The securing mechanism 102 holds the wire ends such that first and second wires 12, 14 are generally parallel to one another along a longitudinal axis X.

Figure 6:
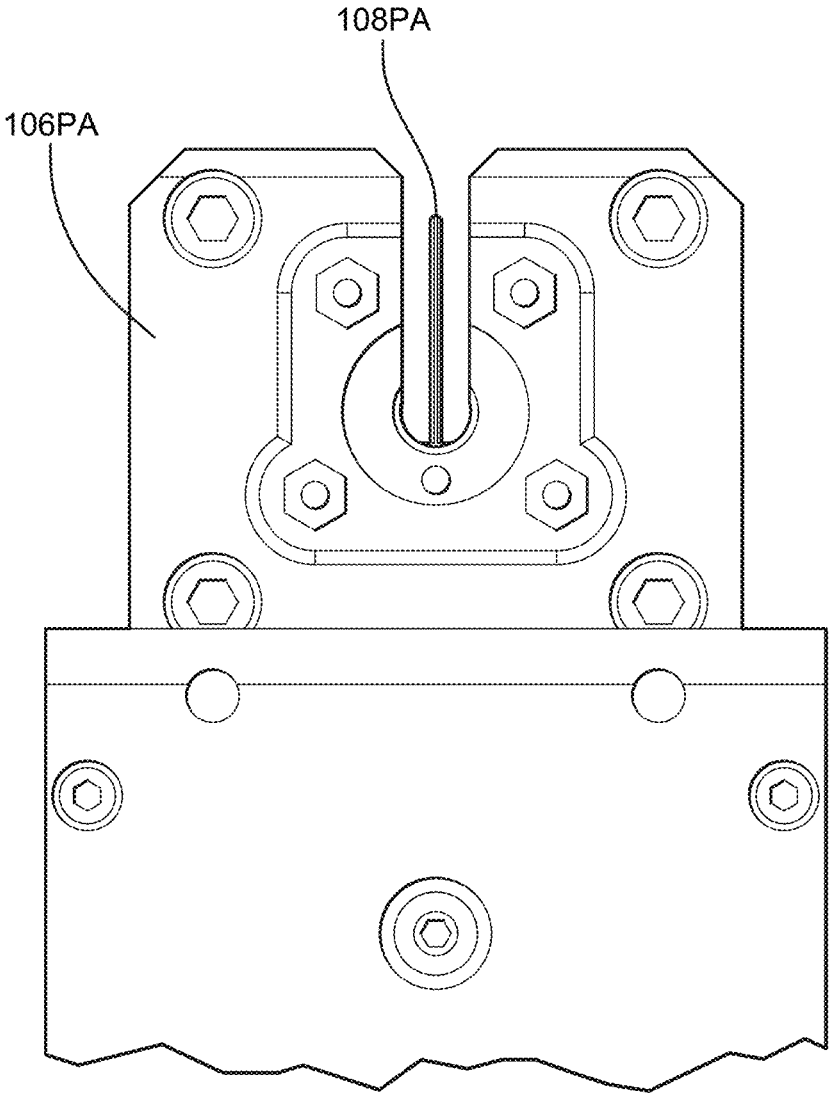
PRIOR ART FIG. 6
FIG. 6 is an end view of gripping mechanism according to the prior art.

The apparatus 100 also includes a gripping mechanism 106 is configured to grip central portions 18 of the first and second wires 12, 14 this is located generally at the midpoint of the distance between the ends of the first and second wires 12, 14. As shown in FIG. 6, a prior art gripping mechanism 106PA included a pin 108PA that was placed between the first and second wires 12, 14. This pin 108PA was rotated around the longitudinal axis X to twist the first and second wires 12, 14 about one another. This pin 108PA forms a gap between the first and second wires 12, 14 that remained after the wires are twisted. The inventors recognized that this gap degrades the electrical performance of the cable, especially for differential transmission of digital data signals, due to a variation in impedance around the gap. The gripping mechanism 106 of the apparatus 100 eliminates the gap between the first and second wires 12, 14 in the central portion, thereby providing improved electrical performance.

The gripping mechanism 106 is configured to grip the central portions 18 of the first and second wires 12, 14 such that inner surfaces of the insulation layers of the first and second wires 12, 14 in the central portions 18 are in contact with one another, preferably in uninterrupted or continuous contact with one another. As used herein, the first and second wires 12, 14 being in contact means that they are separated by a distance of less than 100 micrometers.

Figure 7:
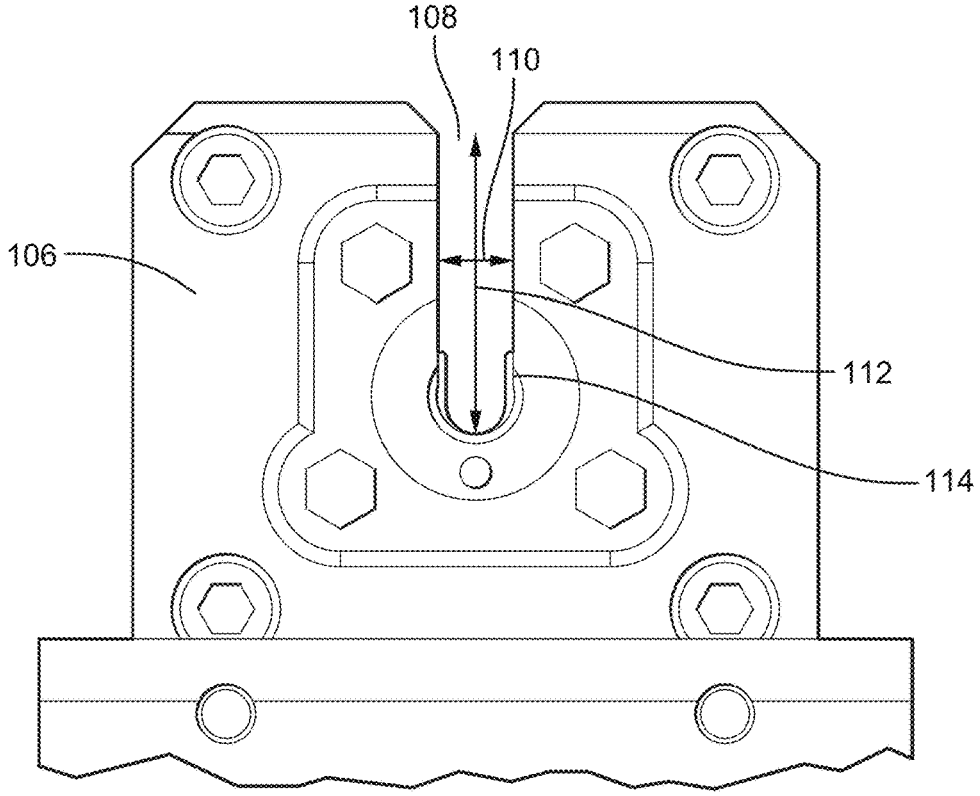
FIG. 7 is an end view of a gripping mechanism in a condition to receive a pair of wires according to an embodiment.

As shown in FIG. 7, the gripping mechanism 106 defines a U-shaped groove 108 that is configured to receive and grip the central portions 18 of the first and second wires 12, 14. A width 110 of the U-shaped groove 108 is greater than a diameter of the first and second wires 12, 14 when the first and second wires 12, 14 are received within the U-shaped groove 108 and the width 110 of the U-shaped groove 108 is less than or equal to the diameter of the first and second wires 12, 14 when the first and second wires 12, 14 are gripped within the U-shaped groove 108. A depth 112 of the U-shaped groove 108 is greater than or equal to the diameter of the first wire 12 plus the diameter of the second wire 14.

Figure 8:
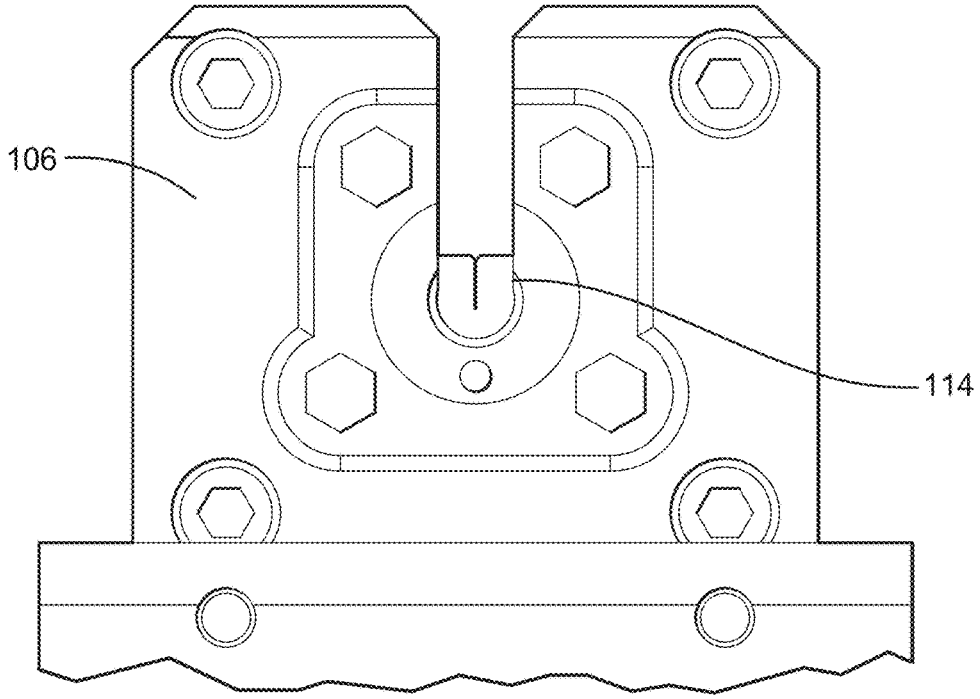
FIG. 8 is an end view of the gripping mechanism of FIG. 7 in a condition to grip a pair of wires according to an embodiment.

In the illustrated example, the U-shaped groove 108 is defined by an inflatable U-shaped bladder 114 configured to receive and grip the central portions 18 of the first and second wires 12, 14. As shown in FIG. 7, the U-shaped bladder 114 is uninflated to allow the wires to be placed within the U-shaped groove 108. As shown in FIG. 8, the U-shaped bladder 114 is inflated to grip the first and second wires 12, 14 while holding the central portion. After twisting the wires, the U-shaped bladder 114 is deflated to release the twisted wire pair 12, 14. The U-shaped bladder 114 may be a pneumatic bladder or a hydraulic bladder. Inflation and deflation of the U-shaped bladder 114 may be performed by manually or automatically controlled pumps and valves.

In alternative embodiments of the apparatus, the gripping mechanism may include jaws or clamps to grip the wires. The jaws or clamps are brought into direct contact or near contact with one another to grip the wires. These jaws or clamps preferably include a complaint material on the gripping edges to inhibit damage to the wires caused by gripping and during rotation of the gripping mechanism. When the arms are in contact with one another, the respective U-shaped grooves form a channel substantially surrounding the first and second wires of the twisted pair.

Inventors have found that the U-shaped bladder 114 provides a reduced risk of damage to the wires than the alternative gripping mechanisms.

Figure 1B:
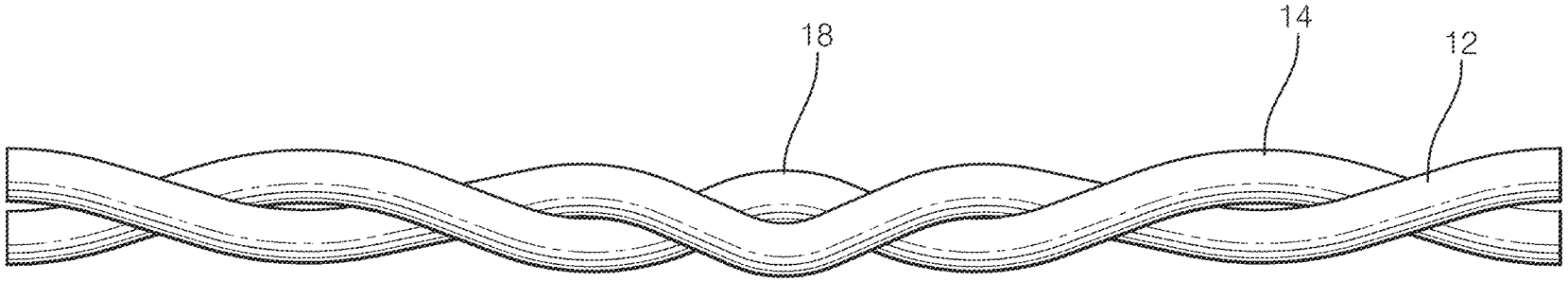
FIG. 1B is a side view of a twisted pair of wires formed by any one of the embodiments.
Figure 2:
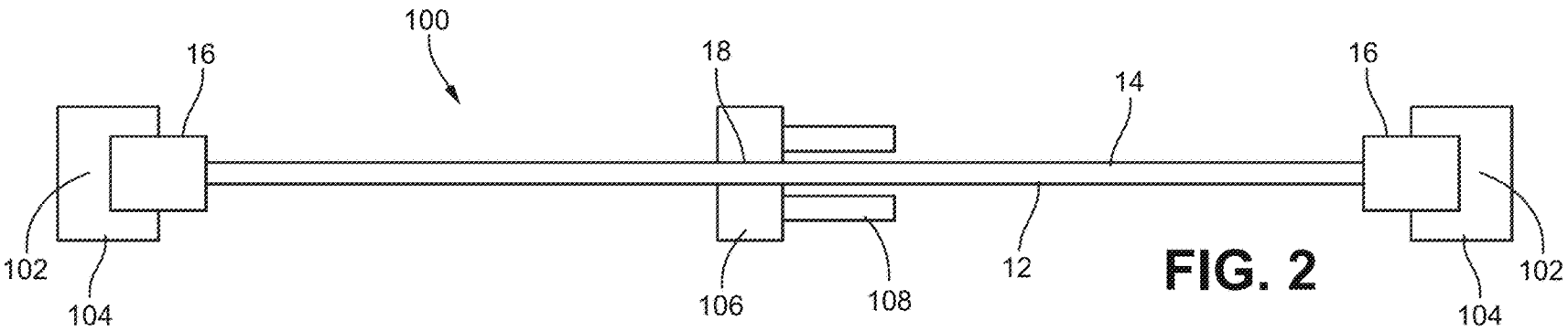
FIG. 2 is a schematic view of an apparatus configured to center twist a pair of wires according to an embodiment.
Figure 3:
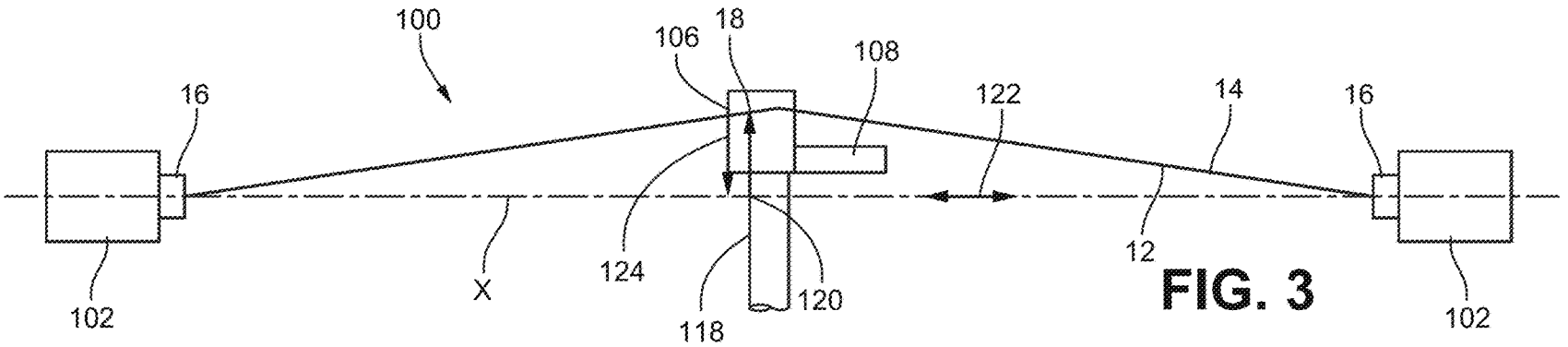
FIG. 3 is another schematic view of an apparatus configured to center twist a pair of wires according to an embodiment.
Figure 4:
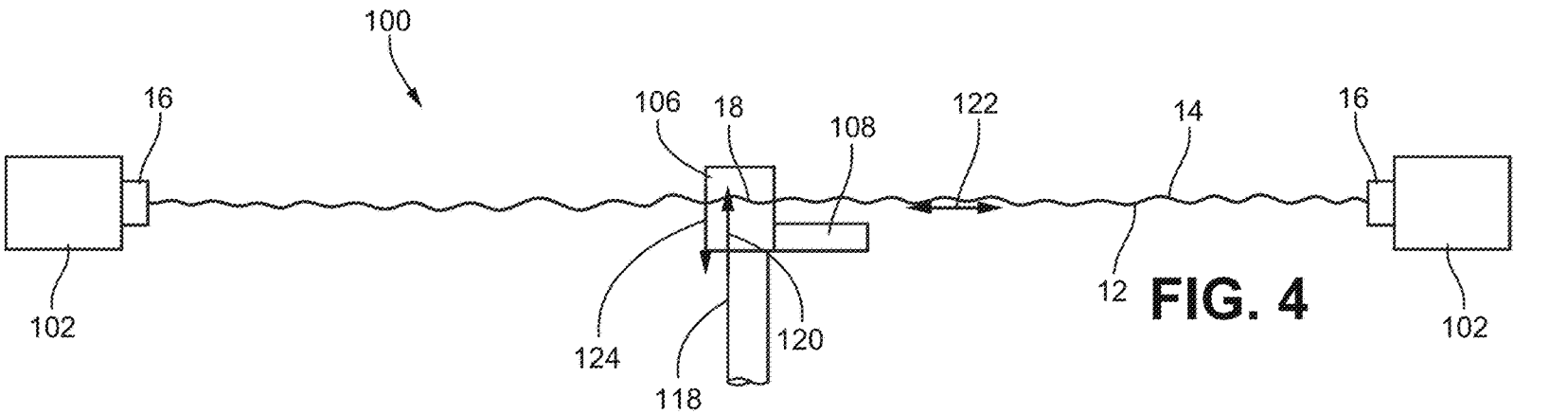
FIG. 4 is yet another schematic view of an apparatus configured to center twist a pair of wires according to an embodiment.
Figure 5:
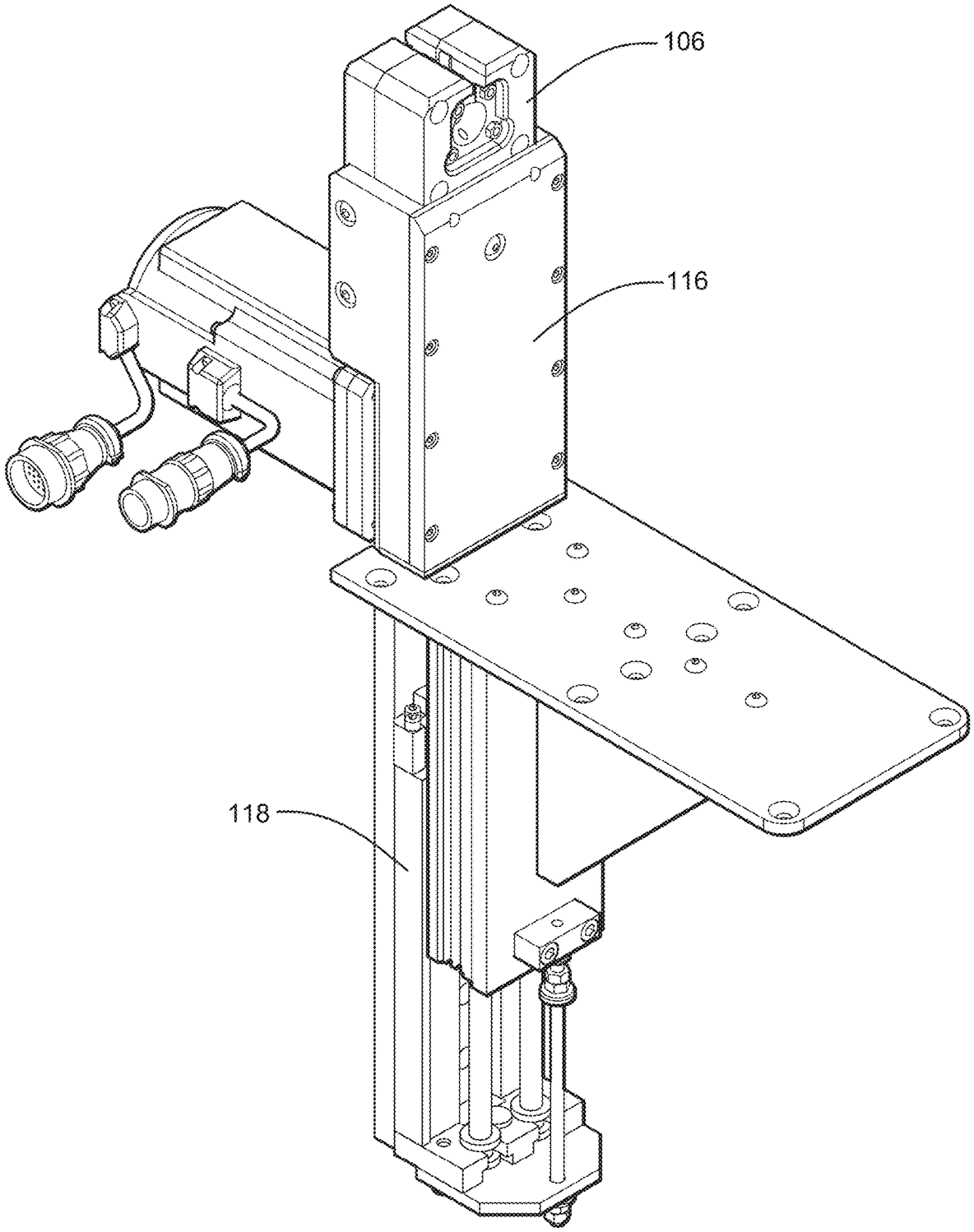
FIG. 5 is a perspective view of a gripping mechanism, a tensioning mechanism, and a rotating mechanism according to an embodiment.
Figure 9:
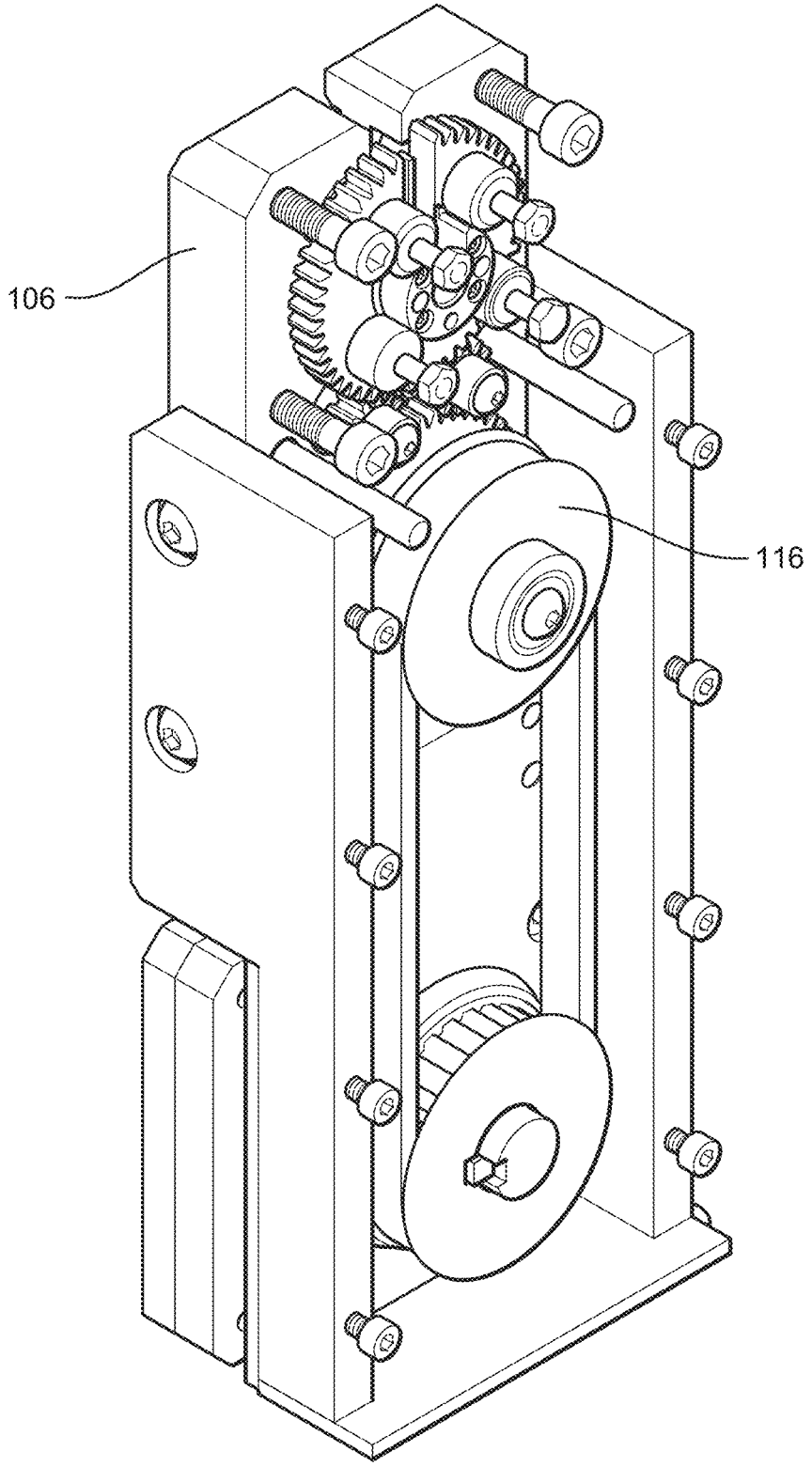
FIG. 9 is a cut-away view of the gripping mechanism of FIG. 7 according to an embodiment.

The apparatus 100 also includes a rotating mechanism 116 configured to rotate the gripping mechanism 106, thereby twisting the first and second wires 12, 14 about one another such that the first and second wires 12, 14 are right-hand helically twisted about one another on one side of the central portions 18 and the first and second wires 12, 14 are left-hand helically twisted about one another on an opposite side of the central portions 18 as shown in FIG. 1B, herein referred to as center twisting. Center twisting provides the benefit of allowing pairs of wires to be twisted after the wires are terminated and inserted within connector bodies which allows a greater level of automation to be employed in assembling a wire harness which includes twisted pairs of wires. As shown in FIG. 9, the gripping mechanism 106 has a toothed outer edge and the rotating mechanism 116 has a pair or gears engaged with the toothed edge that causes the gripping mechanism 106 to rotate. One gear will continue to drive the gripping mechanism 106 when the other gear is in the U-shaped groove 108.

The illustrated apparatus 100 also includes a tensioning mechanism 118 that is configured to apply a lateral offsetting force 120 to the gripping mechanism 106, thereby laterally deflecting the central portions 18 of the first and second wires 12, 14 orthogonally from the longitudinal axis X. As the first and second wires 12, 14 are twisted, the length of the twisted wire pair 12, 14 decreases causing a longitudinal tension force 122 in the twisted wire pair 12, 14. Since the tensioning mechanism 118 has laterally offset the first and second wires 12, 14, the longitudinal tension force 122 has a lateral tension force 124 component that is exerted against the lateral offsetting force 120 of the tensioning mechanism 118. Preferably, the lateral offsetting force 120 is greater than or equal to lateral tension force 124.

The tensioning mechanism 118 may include an extension spring or pneumatic spring to passively generate the offsetting force. Alternatively, the tensioning mechanism 118 may include a pneumatic actuator, a hydraulic actuator, or an electrical servo motor to actively generate the offsetting force. The apparatus 100 may include a controller (not shown) connected to tension measuring device (not shown) in the securing mechanism 102, such as a strain gauge to measure the longitudinal tension force 122, calculate the lateral tension force 124 and command the tensioning mechanism 118 to apply the appropriate lateral offsetting force 120.

The tensioning mechanism 118 provides the benefit of individually applying the offsetting force to one pair of wires at a time, thereby allowing multiple twisted pairs in a wiring harness because the force offsetting the longitudinal tension force 122 is applied laterally. It may be possible to apply a longitudinal offsetting force when center twisting a wire pair secured within a connector body, however applying a longitudinal offsetting force is undesirable for multiple twisted pairs in a single wiring harness, since the distance between the connector bodies is decreased after the first wire pair is twisted and it would be very difficult to apply a longitudinal offsetting force to a second wire pair.

Alternative embodiments of the apparatus 100 may be envisioned that do not include the tensioning mechanism 118 while other embodiments may be envisioned which use other gripping means, such as the pin 108PA of the prior art shown in FIG. 6.

Figure 10:
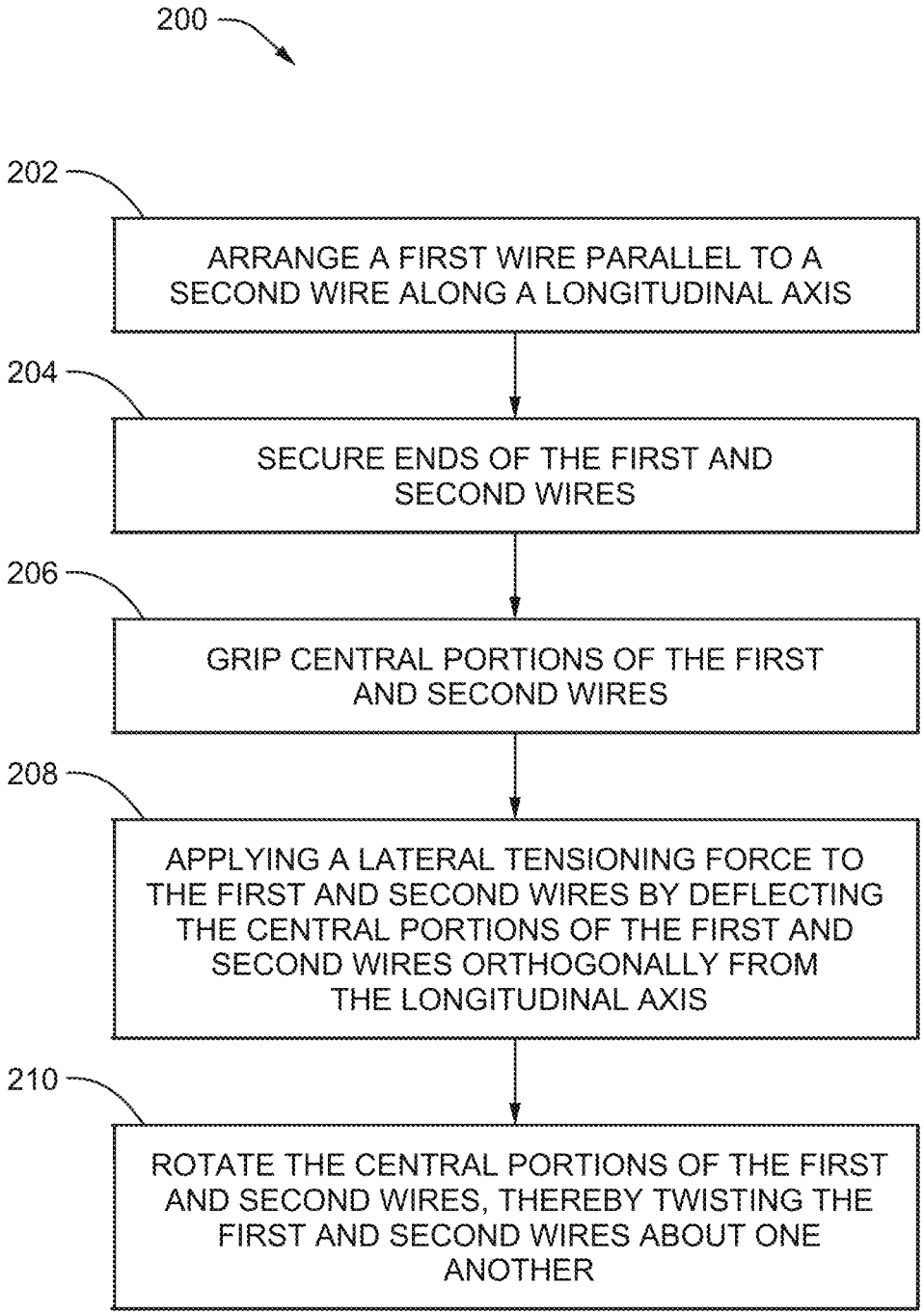
FIG. 10 is flow chart of a method of center twisting a pair of wires according to an embodiment.

FIG. 10 illustrates a method 200 of twisting a pair of wires. The method 200 includes the following steps:

STEP 202, ARRANGE A FIRST WIRE PARALLEL TO A SECOND WIRE ALONG A LONGITUDINAL AXIS, includes arranging a first wire 12 parallel to a second wire 14 along a longitudinal axis X;

STEP 204, SECURE ENDS OF THE FIRST AND SECOND WIRES, includes securing ends of the first and second wires 12, 14 to maintain the parallel arrangement. STEP 204 may be performed by the securing mechanism 102 described above;

STEP 206, GRIP CENTRAL PORTIONS OF THE FIRST AND SECOND WIRES, includes gripping central portions 18 of the first and second wires 12, 14. STEP 206 may be performed by the gripping mechanism 106 described above;

STEP 208, APPLYING A LATERAL TENSIONING FORCE TO THE FIRST AND SECOND WIRES BY DEFLECTING THE CENTRAL PORTIONS OF THE FIRST AND SECOND WIRES ORTHOGONALLY FROM

THE LONGITUDINAL AXIS, applying a lateral offsetting force to the first and second wires 12, 14 by deflecting the central portions 18 of the first and second wires 12, 14 orthogonally from the longitudinal axis X. STEP 208 may be performed by the tensioning mechanism 118 described above;

STEP 210, ROTATE THE CENTRAL PORTIONS OF THE CENTRAL PORTIONS OF THE FIRST AND SECOND WIRES, THEREBY TWISTING THE FIRST AND SECOND WIRES ABOUT ONE ANOTHER, includes rotating the central portions 18 of the first and second wires 12, 14, thereby twisting the first and second wires 12, 14 about one another. STEP 210 is performed after STEP 208. A longitudinal tension force 122 caused by the twisting of the first and second wires 12, 14 is less than or equal to the lateral offsetting force 120 during STEP 208. The longitudinal tension force 122 is preferably equal to the lateral offsetting force 120 after the completion of STEP 210. The deflected central portions 18 of the first and second wires 12, 14 are drawn toward the longitudinal axis X by an increase in the longitudinal tension force 122 during STEP 210. STEP 210 may be performed by the gripping mechanism 106 and the rotating mechanism 116 described above. A tape may be applied to the central portions to hold the first and second wires 12, 14 in contact after the completion of STEP 210.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

We claim:

1. A method of twisting a pair of wires, comprising:

a) arranging a first wire parallel to a second wire along a longitudinal axis;

b) securing ends of the first and second wires;

c) gripping outer surfaces of central portions of the first and second wires using a gripping mechanism, wherein inner surfaces of the central portions of the first and second wires are in contact with one another;

d) deflecting central portions of the first and second wires orthogonally from the longitudinal axis using a tensioning mechanism applying a lateral offsetting force to the gripping mechanism; and e) rotating the central portions of the central portions of the first and second wires, thereby twisting the first and second wires about one another.

2. The method according to claim 1, wherein the tensioning mechanism includes an extension spring.

3. The method according to claim 1, wherein the tensioning mechanism includes a pneumatic spring.

4. The method according to claim 1, wherein the tensioning mechanism includes a pneumatic actuator.

5. The method according to claim 1, wherein the tensioning mechanism includes a hydraulic actuator.

6. The method according to claim 1, wherein the tensioning mechanism includes an electrical servo motor.

7. The method according to claim 1, wherein a longitudinal tension force caused by the twisting of the first and second wires is less than or equal to the lateral offsetting force during step e).

8. The method according to claim 7, wherein the longitudinal tension force is equal to the lateral offsetting force after completion of step e).

9. The method according to claim 8, wherein the deflected central portions of the first and second wires are drawn toward the longitudinal axis by an increase in the longitudinal tension force during step e).

10. The method according to claim 1, wherein the gripping mechanism is rotated by a rotating mechanism during step e).

11. The method according to claim 1, wherein the inner surfaces of the central portions of the first and second wires are in continuous contact with one another during steps c), d), and e).

12. The method according to claim 1, wherein the ends of the first and second wires are attached to electrical terminals.

13. The method according to claim 12, wherein the electrical terminals are contained within electrical connector housings.

14. The method according to claim 1, wherein step e) forms a right-hand helical twist in the first and second wires on one side of the central portions of the first and second wires and forms a left-hand helical twist in the first and second wires on an opposite side of the central portions of the first and second wires.

* * * * *